US008388472B2

(12) United States Patent
Blais et al.

(10) Patent No.: US 8,388,472 B2
(45) Date of Patent: Mar. 5, 2013

(54) SPORT GAME

(76) Inventors: Jonathan Blais, Southington, CT (US); Ryan Bussett, Plantsville, CT (US); Alex Pajor, Meriden, CT (US); Andy Manke, Southington, CT (US)

( * ) Notice: Subject to any disclaimer, the term of this patent is extended or adjusted under 35 U.S.C. 154(b) by 283 days.

(21) Appl. No.: 12/804,994

(22) Filed: Aug. 3, 2010

(65) Prior Publication Data

US 2011/0059818 A1 Mar. 10, 2011

Related U.S. Application Data

(60) Provisional application No. 61/273,261, filed on Aug. 3, 2009.

(51) Int. Cl.
*A63B 63/08* (2006.01)

(52) U.S. Cl. ..... 473/476; 473/415

(58) Field of Classification Search ..... 473/470, 473/471, 469, 468, 467, 465, 415, 476; 404/12; 472/90; 52/745.05
See application file for complete search history.

(56) References Cited

U.S. PATENT DOCUMENTS

| | | | | | |
|---|---|---|---|---|---|
| 3,037,593 | A * | 6/1962 | Webster | 52/476 |
| 3,923,304 | A * | 12/1975 | Warren | 473/471 |
| 4,203,594 | A * | 5/1980 | Cagle | 473/471 |
| 4,284,277 | A * | 8/1981 | Leonard et al. | 473/471 |
| 5,531,452 | A * | 7/1996 | Gigante | 473/471 |
| 5,599,025 | A * | 2/1997 | Pobee-Mensah | 473/471 |
| 5,993,335 | A * | 11/1999 | Eden et al. | 473/471 |
| 6,004,218 | A * | 12/1999 | Keating et al. | 472/94 |
| 6,394,918 | B1 * | 5/2002 | Erhard | 473/421 |
| 2007/0021241 | A1 * | 1/2007 | Geller et al. | 473/415 |
| 2007/0129184 | A1 * | 6/2007 | Anderson | 473/470 |
| 2011/0059818 | A1 * | 3/2011 | Blais et al. | 473/471 |
| 2011/0160006 | A1 * | 6/2011 | Mcardle et al. | 473/498 |

* cited by examiner

*Primary Examiner* — Gene Kim
*Assistant Examiner* — M Chambers
(74) *Attorney, Agent, or Firm* — Steven M. McHugh

(57) ABSTRACT

A plurality of articles for playing a sport game, the plurality of articles including a game ball, a plurality of goal rods and a sport court having a court top, a court base, two court sides and two court ends which define a game space, wherein the court top includes open areas on each end of the court top, wherein the open areas are separated by a studded area, the court base is divided into four sections, wherein the four sections include a goal zones separated by neutral zones, each of the two court sides include a flat portion and a studded portion, and each of the two court ends includes a goal opening.

20 Claims, 5 Drawing Sheets

SPORT GAME

CROSS REFERENCE TO RELATED APPLICATIONS

This application claims the benefit of U.S. Provisional Patent Application No. 61/273,261, filed Aug. 3, 2009 and entitled "Defender the Sport" the contents of which are incorporated herein by reference in its entirety.

FIELD OF THE INVENTION

This invention relates generally to a new ball game and more particularly to a new action sport that allows for gameplay between two players.

BACKGROUND OF THE INVENTION

Sport games are well known and in fact occupy a great deal of time, interest and energy of youngsters and adults alike. Sport games like Baseball, Football, Lacrosse, Soccer, Tennis and Basketball are not only played on the professional level, but also on the semi-professional level, school level and recreational level as well. However, each of these games is played on a rather large scale, typically requiring substantial space and several players (and referees) to be played as the originators intended (with the exception of basketball which may be played as one on one).

Presently, there are very few sport games that are originally intended for only two players and that provide a fast paced sport game that is easy to learn and play. One such two player game is Squash, which was originally developed in the 1500s from several other sports. Another such game is Racquetball, which was originally invented around 1952.

What is needed is a fast pace sport game that ensures excitement and unpredictability and that is played in a smaller game space than other sport games, such that the game space may be portable and easy to set up and transport.

SUMMARY OF THE INVENTION

A method of playing a game, wherein the game is played by a first and second player in a game space of a sport court having a court top, a court base, two court sides and two court ends, wherein each of the first and second player have goal rods and each of the two court ends includes a goal opening, the method including locating the first and second player and a game ball inside of the game space, such that the first player is on one end of the game space and the second player is on the opposite end of the game space, beginning game play by causing the first player to hit the game ball inside of the game space with the intent of making the game ball enter the second players goal opening, continuing the game play by causing the second player to hit the game ball to prevent the game ball from entering the second players goal opening with the intent of making the game ball enter the first players goal opening and maintaining game play until at least one of the first player and the second player achieves a point by hitting the game ball into the other players goal opening.

A plurality of articles for playing a sport game, the plurality of articles including a game ball, a plurality of goal rods and a sport court having a court top, a court base, two court sides and two court ends which define a game space, wherein, the court top includes open areas on each end of the court top, wherein the open areas are separated by a studded area, the court base is divided into four sections, wherein the four sections include a goal zones separated by neutral zones, each of the two court sides include a flat portion and a studded portion, and each of the two court ends includes a goal opening.

A method of playing a game, wherein the game is played by a first and second player in a game space of a sport court having a court top, a court base, two court sides and two court ends, wherein each of the two court ends includes a goal opening. The method includes locating the first and second player and a game ball inside of the game space, such that the first player is on a first end of the game space and the second player is on a second end of the game space, beginning game play by causing the first player to hit the game ball inside of the game space with the intent of making the game ball enter the second players goal opening, continuing the game play by causing the second player to hit the game ball to prevent the game ball from entering the second players goal opening with the intent of making the game ball enter the first players goal opening and maintaining game play until at least one of the first player and the second player achieves a point by hitting the game ball into the other players goal opening.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike.

DETAILED DESCRIPTION OF THE INVENTION

Figure 1A:
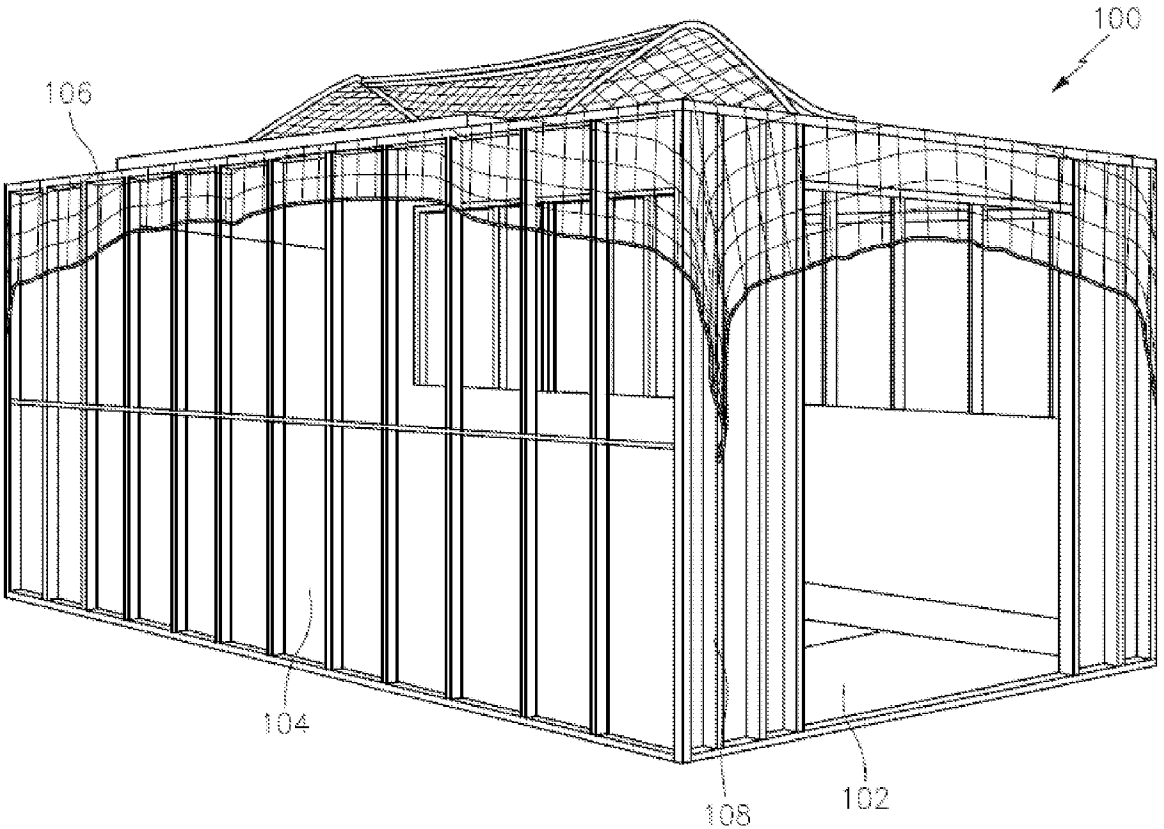
FIG. 1*a* is front perspective view of a sport court, in accordance with an exemplary embodiment of the present invention.
Figure 1B:
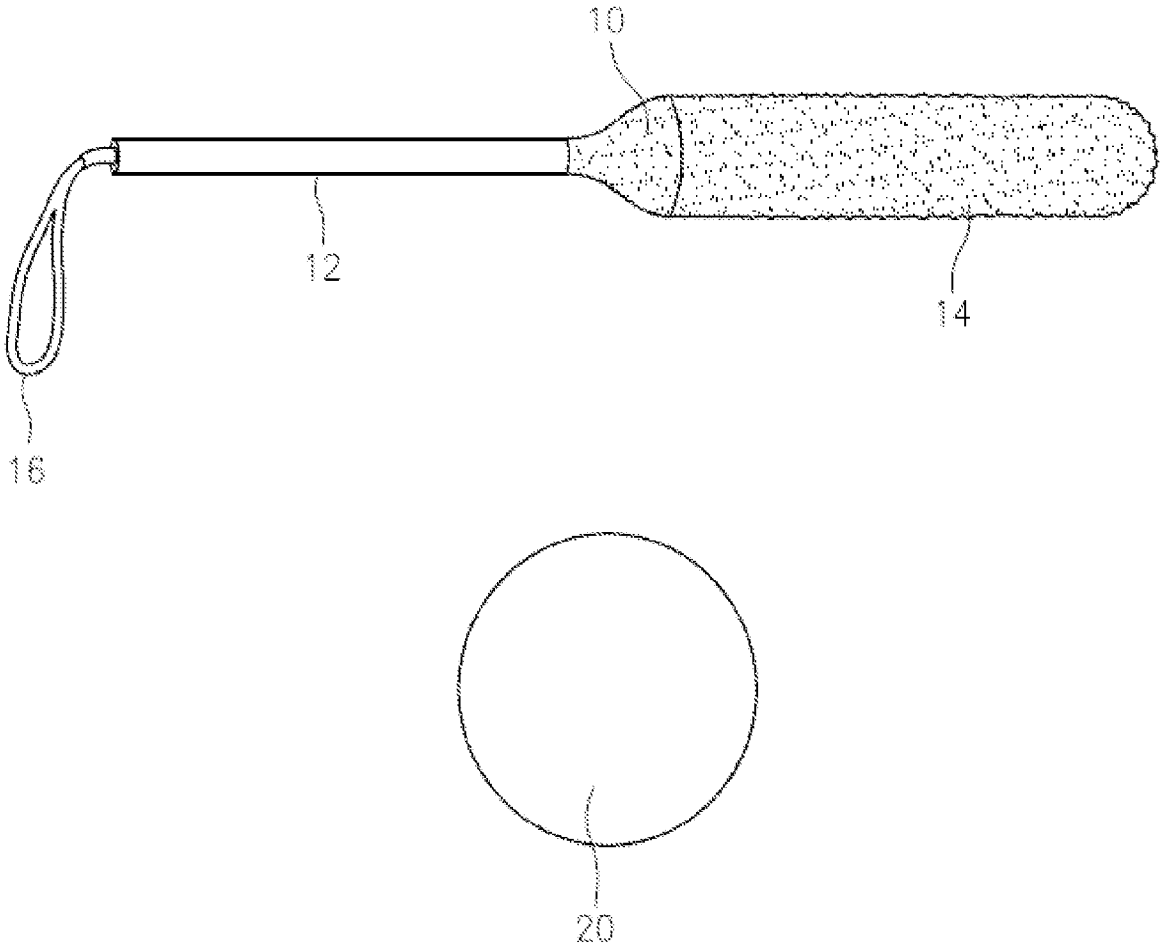
FIG. 1*b* is front perspective view of a defender ball and a goal rod, in accordance with an exemplary embodiment of the present invention.

As disclosed herein with regards to an exemplary embodiment, a new fast paced game sport (referred to hereinafter as "Defender") is described, where Defender is played by two players using a goal rod 10 (each player has a goal rod 10) and a defender ball 20 on a sport court 100 having a court base 102, two court side walls 104, a court top 106 and two court end walls 108 which define a game space therebetween, each of which is illustrated in FIG. 1*a* and FIG. 1*b*.

The Playing Court

Figure 2:
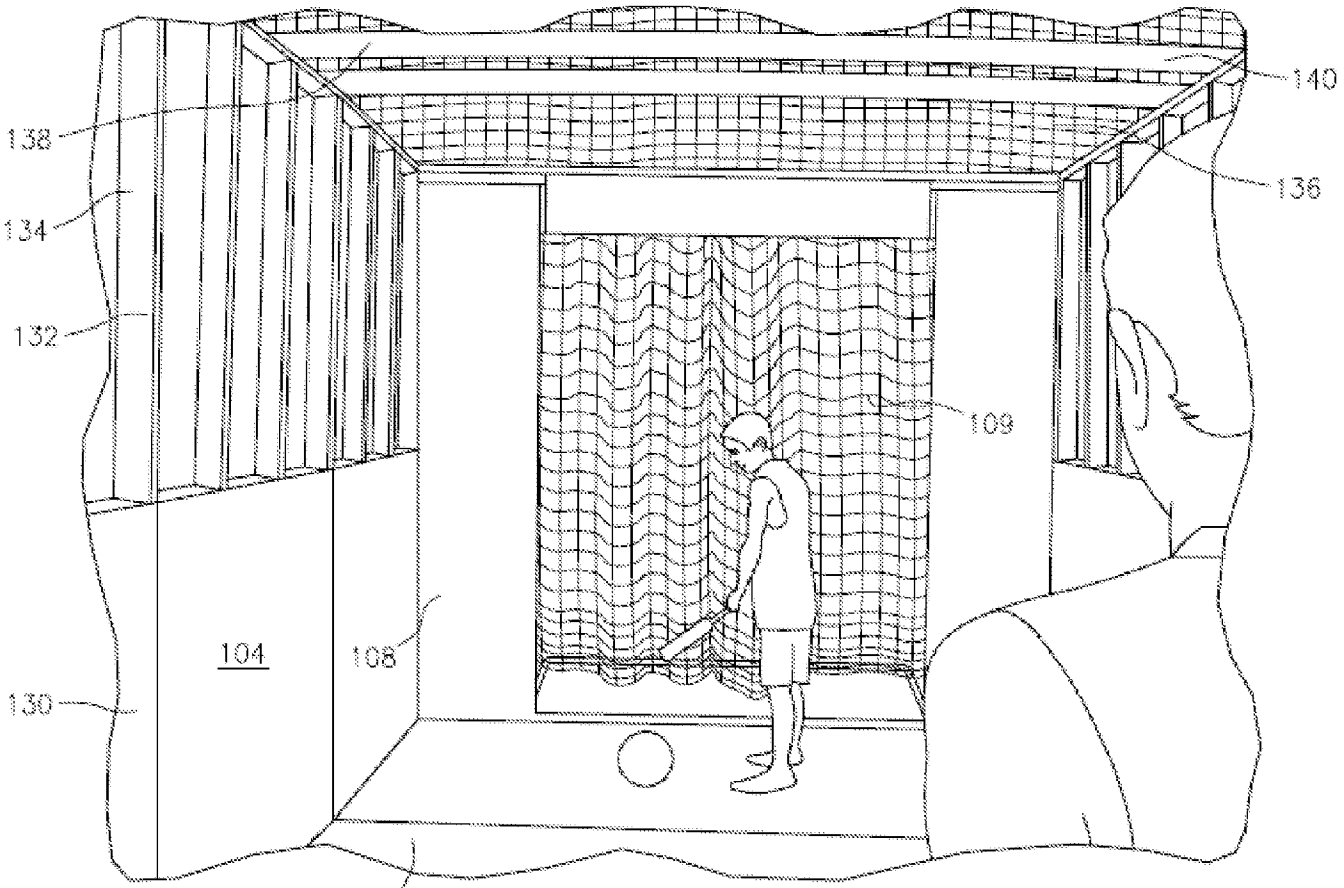
FIG. 2 is a front view of the sport court of FIG. 1*a*.
Figure 3:
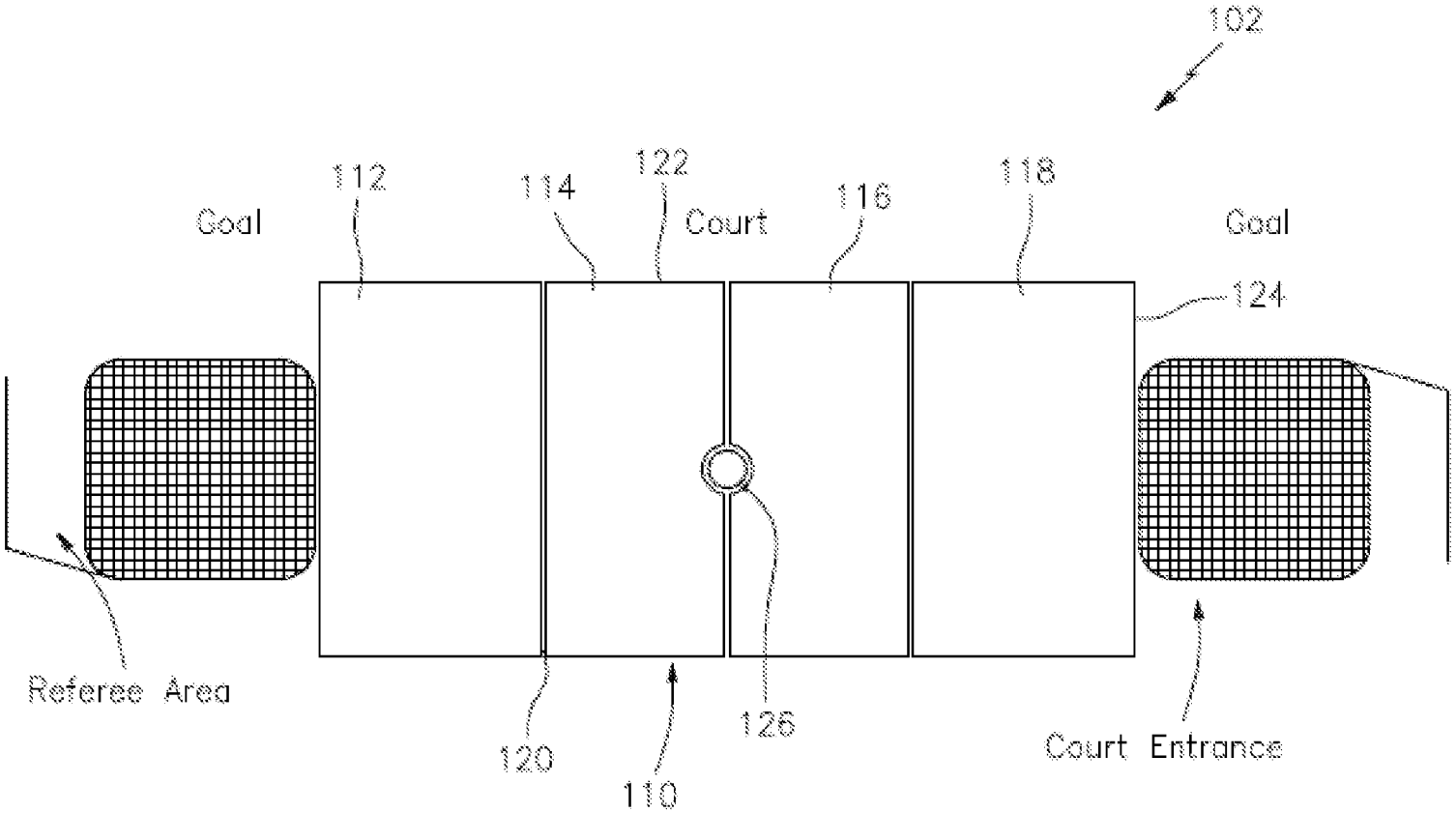
FIG. 3 is a top down view of the court base of the sport court of FIG. 1*a*.

Referring to FIG. 1*a* and FIG. 2, a sport court 100 is shown and includes a court base 102, two court side walls 104, a court top 106 and two court end walls 108, one located at one end of the court base 102 and the other located at the opposite end of the court base 102. The sport court base 102 and the court top 106 are preferably about 20 feet in length and about 10 feet in width and each of the two court side walls 104 are preferably about 20 feet in length and about 8 feet in height. Referring to FIG. 3, the court base 102 is substantially flat and may be divided up into four quadrants, or segments 110, each of which are substantially equal in size to each other. The four segments 110 include a first segment 112, a second segment 114, a third segment 116 and a fourth segment 118, where the first segment 112 and the fourth segment 118 are goal zones and the second segment 114 and third segment 116 make up a neutral zone. It should be appreciated that the neutral zone is typically ten feet in length and ten feet in width and the goal zones are each typically five feet in length and ten feet in width. Located between the first segment 112 and the second segment 114 (and the third segment 116 and the fourth segment 118) is a goal zone line 120 and located between the second segment 114 and the third segment 116 is a centerline 122. It should be appreciated that the goal zone line 120 divides the goal zone from the neutral zone and the centerline 122 divides the neutral zone into two halves and is located at the center of the sport court 100, parallel with the goal zone lines 120. Additionally, located at each end of the court base 102 are goal lines 124 which divide the goal zone from the outside of the goal or sport court 100. Located centrally to the court base 102 is a face-off circle 126, where the face-off circle 126 may contain a device for holding the defender ball 20 in place for face-offs (or the court base 102 may be designed with a depression to hold the defender ball 20).

Each of the two court side walls 104 includes a flat wall section 130 and a studded wall section 132, each of which typically have a section height of 4 feet and run the length of the court side walls 104. The studded wall section 132 includes a plurality of studs 134 located approximately about every ten to twenty inches along the length of the court side walls 104. The external portion of the court side walls 104 may include fencing or netting (they may or may not be see through) or some other suitable material to prevent the ball from exiting the sport court 100 via the court side walls 104. In accordance with the present invention, although the studs are preferably 2 inches×4 inches×8 foot wooden studs, they may be constructed of any material suitable to the desired end purpose, such as plastic and/or metal. Each of the two court end walls 108 are preferable 10 feet in width and 8 feet in height and include a goal opening 109 that is centered on the court end wall 108 and that is about 5 feet in width and about 7 feet in height. However, it is contemplated that the goal opening 109 may be any size suitable to the desired end purpose. For example, the goal opening 109 may be smaller to increase the difficulty of the sport game for experienced players or the goal opening 109 may be larger to decrease the difficulty of the sport game for novice players The court top 106 includes an open area 136 on each end of the sport court 100 and a studded section which is an about 10 foot long section 138 having a plurality of studs 140 located in an area approximately about the middle of the court top 106 positioned approximately about every 20 inches (may be ten to twenty inches) from each other along the length of the section 138. Although, the plurality of studs 140 typically rest across the entire width of the court top 106, it is contemplated that they may only span a portion of the width of the court top 106. A net or other type of containment material is positioned over the court top 106 to prevent the ball 20 from escaping to the outside during game play.

Figure 5:
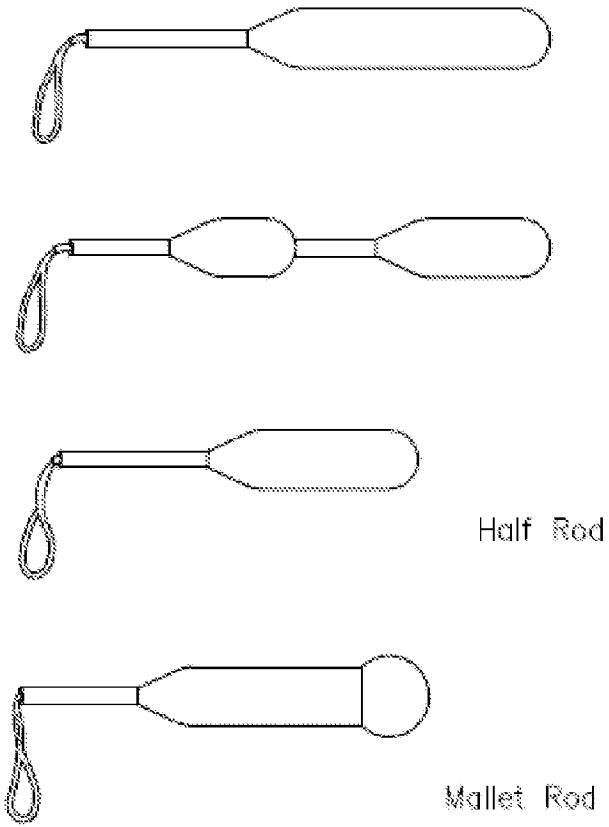
FIG. 5 is a front view of several other variations of a goal rod, in accordance with the present invention.
Figure 4:
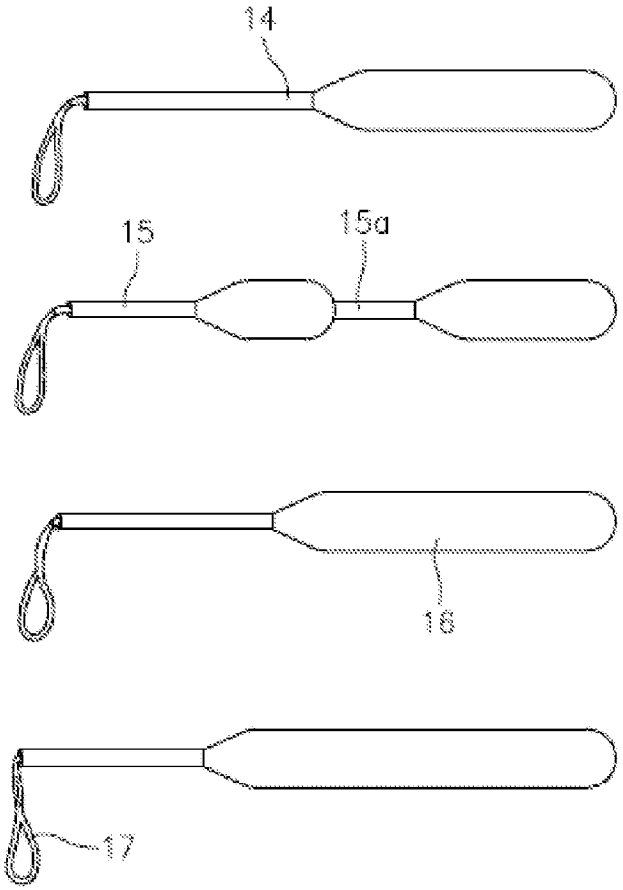
FIG. 4 is a front view of several variations of a goal rod, in accordance with the present invention.

Referring back to FIG. 1*b*, one embodiment of the goal rod 10 is shown and may be constructed from a wooden dowel that is approximately about 2 feet in length and that may include a handle portion 12 and a padded portion 14. It is contemplated that the handle portion 12 may be approximately about ½ inch thick (thickness may range from about ¼ inch to 1 inch thick) and the padded portion 14 may be approximately about 3 inches thick (thickness may range from about 2 inches to 4 inched thick). It is further contemplated that other size goal rods may be used. The padded portion may be constructed by surrounding or wrapping the wooden dowel with a padded material, such as a thick foam material. The handle portion 12 may include a wrist strap 16 and wrapped (at least partially) in a gripping material to help a player grip the goal rod 10 more securely. The ball 20 is preferably constructed from a light plastic material and is preferably the size of a soccer or volley ball. Referring to FIG. 4 and FIG. 5, it should be appreciated that other variations of the goal rod 10 are contemplated and may have multiple sizes, padded sections, handle sections or shapes. However, all players must use the same type of goal rod 10 in a single tournament or official game. It is contemplated that the sport game 100 may be without goal rods 10, using only the hands or feet as instruments to hit the defender ball 20.

It should be appreciated that the following should be adhered to:

- The sport court 100 should be 20 feet long and 10 feet wide. The 4 quadrants that make up the interior base of the court should all be the same size. This means that the goal zones and the two halves of the neutral zone should be 5 feet long by 10 feet wide.
- The court side walls 104 should have a substantially flat section of wall that covers about half height of the side wall 104. The remainder of the wall that is not covered by the flat section should be made up of studded wall sections or some variation designed to cause the defender ball 20 to bounce off in an unpredictable manner or direction.
- The goals at either end of the sport court 100 should be about 7 feet in height and 5 feet in width.
- The studded section 138 should cover at least half of the court top 106. This section should be made up of studs similar to the side walls 104 or some other variation designed to cause the defender ball 20 to bounce off in an unpredictable manner or direction.

Serves

Defender the sport is a two player game, where one player competes against the other player on the sport court 100, where both players are equipped with a goal rod 10. The players begin the game on opposite ends of the sport court 100, wherein one player is located near one of the two court end walls 108 and the other player is located near the other of the two court end walls 108. Each defender game is made up of three matches and each match is made up of three rounds. A defender round begins by placing the defender ball 20 in the face-off circle 126 (which may or may not contain a device for holding the defender ball 20) of the sport court 100 and sounding a face-off whistle sound. Typically, there is a five second countdown between placement of the defender ball 20 and the face-off whistle sound. However, this time may be adjusted as desired. When the face-off whistle sounds, each player must have either a hand or a foot in contact with the goal line 124 associated with their end of the sport court 100. The object of the defender game is for a player to successfully locate the defender ball 20 into the goal opening 109 associated with the other player. Each time a defender ball 20 enters the goal opening 109 of one of the players, the other player receives a point. A defender round is won when a player scores 11 points against their opponent. A defender match is won when a player is the first to win three rounds. A defender game is won when a player is the first to win three matches.

A serve is when (after a goal is scored on that player or that player was awarded a serve due to a penalty on the other player) a player makes the defender ball 20 cross any part of the centerline 122 without incurring any penalties. When a player scores a goal, that player then gets to attempt a serve on the other player, where the defender ball 20 must be served from behind the goal zone line 120 associated with the serving player. When serving, the serving player must have their feet completely inside the goal zone associated with the serving player (the goal zone line 120 is considered crossed when more than half the defender ball 20 is over the goal zone line 120). Additionally, on a serve, the defender ball 20 must be located substantially on the court base 102. Failure to abide by any of the elements directly above results in a "False Serve Penalty." It should be appreciated that if the defender ball 20 is bouncing higher than about approximately 4 inches, then the defender ball 20 is not considered to be on the court base 102. In order for a serve attempt to be considered a serve, a part of the defender ball 20 must cross the centerline 122.

When the defender ball 20 is being served, the opposing player can only go as far on the court base 102 as the centerline 122. If the player crosses the centerline 122 before the defender ball 20, then there will be an Encroachment Penalty. A fault is attempted serve in which the defender ball 20 crosses a player's goal zone line 120, but does not cross the centerline 122. If a player has two faults in a row, it will result in a False Serve Penalty. Accordingly, the serving player has only one fault opportunity and only has two attempts at serving the defender ball 20. If the serve is not successful on the second attempt, then it is considered a False Serve Penalty. Additionally, if the player attempts to serve and the defender ball 20 goes past the serving player's goal zone line and scores in the serving player's goal before it passes the centerline 122, it is considered a goal for the other player.

Gameplay

Game-play is considered to include all play (i.e. immediately after the beginning of a face-off (The moment the whistle is sounded) or immediately after a serve (the moment the player strikes their ball when serving), etc. . . . ), excluding time-outs, challenges and times in-between serves. At the beginning of a game on a face-off, each player must have an appendage (at least one hand or foot touching) be in contact with their respective goal line 124. This appendage must only be touching their respective goal line 124 and no other part of the sport court 100. When the players are set, the face-off begins after a five second countdown (however, could be more or less than five seconds), upon which a face-off whistle will sound. At the sound of the face-off whistle, both players are free to release contact with their respective goal line 124, at which point the players are in game-play. If a player does not have contact with their respective goal line when the whistle sounds, it will result in a False Start Penalty.

It should be appreciated that a player may not be in contact with (or outside of) the outside of the sport court 100 while making contact with the defender ball 20 during game-play. It should also be appreciated that during game-play a player cannot encroach upon or enter the other player's goal zone, including but not limited to stepping over the other player's goal zone line 120 or touching any part of the sport court 100 or defender ball 20 that is located inside of the other player's goal zone. If a player does encroach upon or enter the other player's goal zone, an Encroachment Penalty will result. It should be appreciated that if a player swings the goal rod 10 and the goal rod 10 "enters" the other player's goal zone but does not touch anything (i.e. wall, floor, ball or other player) then this is not considered an encroachment and thus no Encroachment Penalty results. However, if a player swings the goal rod 10 and the goal rod 10 "enters" the other player's goal zone and contact's something in that goal zone (i.e. wall, floor, ball or other player) then this is considered an encroachment and thus an Encroachment Penalty results.

A goal is officially scored when the defender ball 20 passes through the other player's goal opening 109 and/or makes contact with anything outside of the sport court 100. It should be appreciated that a player may kick the defender ball 20 only if it's in defense of their goal, wherein defense is defined as the defender ball 20 having motion towards that player's goal, and that motion is caused by the other player, or is the result of game-play. (What is defined as "the result of game-play" in this context is up to the discretion of the referees). For example, a player cannot deliberately cause the forward motion of the defender ball 20 towards their own goal for the purpose of kicking the defender ball 20. It should also be appreciated that this type of kick is only considered as an attempt at a goal, not just shuffling the defender ball 20 around. Players are allowed to maneuver or shuffle the defender ball 20 around with their feet. An Illegal Kick Penalty occurs if a player kicks a defender ball 20 that is moving away from their goal, directly causes the motion of a defender ball 20 towards their goal and then kicks it, or if a defender ball 20 is being "shuffled" by the players, and it enters a goal as a result, so long as it wasn't the goal of the person who caused the goal.

It should be appreciated that in one embodiment once the game is started game play continues until a goal is scored, a time-out is called or a penalty is called. If a goal is scored, then game play may begin thereafter. If a time-out or a penalty is called, then the matter is resolved and game play may begin thereafter. It should be appreciated that the referees may be responsible for keeping the games playing based on the game rules and a referee handbook. It should also be appreciated the referees (led by the head referee) may modify rules as desired to suit specific end purposes (i.e. for disabled players, novice players, etc.).

Penalties

The following list of penalties may be applicable to the game-play of defender and include three levels of severity symbolized by a yellow flag, a red flag and a black flag.

For the following penalties, a yellow flag will be thrown into the sport court 100 in the direction of where the penalty occurred to signify a penalty call by the referee:

Encroachment Penalty: Results in loss of point/Face Off

As discussed briefly hereinbefore, an encroachment penalty occurs when a line is crossed where any part of the player's body, including the goal rod 10, touches something in the other player's goal zone. This penalty only applies during game-play and occurs when a player steps over the opponents Goal Zone Line 120 or touches any part of the opposing player's goal zone, when a player hits the defender ball 20 when it's in the opposing player's goal zone and/or if a player is across the centerline 122 as the opponent serves, even if the player being across the centerline 122 prevents the defender ball 20 from becoming a serve (as in not allowing the ball to reach the centerline 122). It should be appreciated that the occurrence of one encroachment penalty does not stop game-play (if game-play is still occurring) and play continues until game-play ends at which point the player may accept or decline the penalty. However, if a second encroachment penalty is called in the same play (play meaning the game has not stopped after the first Encroachment), then game-play is immediately ended. At this point, one of two scenarios has occurred:

1. Player A commits the encroachment, game-play continues and then player B then commits an encroachment. Game-play is ended immediately at the time of the second encroachment. A face-off occurs and game-play is resumed by no loss-of-point for either of the players; or
2. Player A commits the encroachment, game-play continues and then player A commits another encroachment. At this point, game-play is ended immediately and is resumed by the serve going to player B and a loss-of-point for Player A.

False Serve Penalty: Results in Loss of Serve

A False Serve Penalty occurs when 1) a player serves the defender ball 20 when they, or the defender ball 20, is outside of their goal zone, 2) when a player serves the defender ball 20 when it is not on the court base 102 (there is a 4 inch bouncing limit), and/or 3) when a player does not make a serve on their second fault opportunity.

False Start Penalty: Results in Loss of Serve

A False Start Penalty occurs when, during a Face-off, the Face-off Whistle sounds and a player is not in contact with their goal line. Additionally, the player cannot be touching any other part of the court base 102 in the goal zone that has contact with their goal line. In accordance with the invention, the goal lines may be elevated above the court base 102 (for example, by approximately 1½ inches (the width of a 2×4)), whereas the other lines on the sport court 100 are simply lines drawn and are as flat as the rest of the court base 102. A player's foot or hand must be placed on top of this goal line and should only be in contact with the elevated line and not the goal line and the court.

Out-of-Bounds Block Penalty: Results in point going to Opponent

An Out-of-Bounds Block Penalty occurs when 1) a player is touching the outside of the sport court 100 and they touch, block, or prevent a ball from being scored; and/or 2) a player is touching the outside of the sport court 100 and they touch the ball in an attempt to Serve.

Illegal Kick Penalty: Results in serve going to Opponent

An Illegal Kick Penalty occurs when 1) a player attempts to score by kicking the defender ball 20 when it does not have motion toward their goal; and/or 2) a player causes the forward motion of the defender ball toward their goal, and then kicks it. It should be appreciated that if the play is not dead upon the time the Illegal Kick happened, then play continues until game-play has ended. A player can then accept or decline the penalty. If two Illegal Kick penalties are called in the same play (play meaning the game not being stopped after the first Illegal Kick, and another one is called), game-play is immediately ended and one of two possible scenarios may occur:

1. If player A commits the Illegal Kick and as game-play continues, player B commits an Illegal Kick, game-play is ended immediately at the time of the second Illegal Kick and game-play is resumed by a Face-off; and/or
2. If player A commits the Illegal Kick and as game-play continues, player A commits another Illegal Kick, then game-play is ended immediately at the time of the second Illegal Kick and game-play is resumed by a loss-of-point for Player A and a Face-off.

Delay of Game: Results in serve going to Opponent

A Delay of Game Penalty occurs when a player does not take action after 6 seconds (may be more or less than 6 seconds as desired), for example when the defender ball 20 is kept in that player's goal zone. The 6 second count would begin once the defender ball 20 is placed in a player's goal zone after a point is scored, or when the ball ends up in that player's goal zone during game-play. Once the defender ball 20 exits that player's goal zone, the count would be ended. It should be appreciated that in order for the ball to be placed "out" of a player's goal zone, thus ending the count, the defender ball 20 must be more than halfway across the player's goal zone line 120.

Release of Goal Rod: Results in serve going to Opponent

A Release of Goal Rod Penalty occurs when a player let's go of his/her goal rod. Play is stopped upon the time the penalty happened, not when it was called. Moreover, it should be appreciated that it is not a penalty if the goal rod was released in direct defense of their goal (the other player was in no danger or if the goal rod didn't leave that persons goal zone) or if the other player hit it out of his/her hand. This is left up to the referee's discretion. For example, a player may intentionally throw their goal rod 10 at the defender ball 20 in an attempt to stop the defender ball 20 or change its direction so that it doesn't score. If this occurs and the other player(s) were in the area that the goal rod 10 was thrown, a penalty would result. If the other player(s) weren't in the area of where the goal rod 10 was thrown the no penalty would result.

Illegal Hold: Opponent's Serve

An Illegal Hold Penalty occurs when 1) a player holds the defender ball 20 for longer than it would take to drop it (This is typically referred to as 2 seconds holding the ball. However, a player cannot "push" the ball with their hands in any way. This "push" can be referred to as a player moving the ball in a direction (using their hands) and keeping contact with the ball throughout. Typically this is done by pushing the ball using a throwing motion); 2) a player picks up the defender ball 20 with any part of their body or goal rod; 3) a player holds the opponent's goal rod for longer than it would take to let it go (This is typically referred to as 2 seconds holding the goal rod); and/or 3) a player holds any part of the opponent's body for longer than it would take to let them go (This is typically referred to as 2 seconds holding the opponent).

For the following penalties, a red flag will be thrown into the sport court 100 in the direction of where the penalty occurred to signify a penalty call by the referee and can be combined with other penalties if desired:

Illegal Contact: Result in Loss of Point/Loss of Serve

It should be appreciated that this penalty can occur at any time and can apply before the game when both players have entered the sport court 100. Points can be taken away before and after the game at the discretion of the referees. An Illegal Contact Penalty occurs when a player makes unnecessarily rough contact with the opponent, which includes, but is not limited to, punching, excessive shoving, checking, kicking or using the goal rod to demonstrate unnecessary roughness on the opponent.

Unsportsmanlike Conduct: Results in Loss of Point/Loss of Serve

It should be appreciated that this penalty can occur at any time and can apply before the game when both players have entered the sport court 100. Points can be taken away before and after the game at the discretion of the referees. An Unsportsmanlike Conduct Penalty occurs with any activity in which a player is voluntarily disrespectful to the sport court 100, equipment, his/her opponent, and/or the referees.

For the following penalties, a black flag will be thrown into the sport court 100 in the direction of where the penalty occurred to signify a penalty call by the referee and can be combined with other penalties if desired:

Ejection: Results in Disqualification/Removal From Game

It should be appreciated that this penalty can occur at any time and can apply before the game when both players have entered the sport court 100 at the discretion of the referees. An Ejection Penalty can occur 1) if a player receives three Red Flag Penalties in one round, 2) if a player demonstrates behavior similar to that of an Illegal Contact Penalty or Unsportsmanlike Conduct Penalty, only on a higher or more extreme level, 3) if a player continues to receive a steady amount of red flag penalties in a match, game, or tournament, and/or 4) if it is obvious a player is intentionally misbehaving. It should be appreciate that aside from three red flag penalties in one round, only the Head Referee has the ability to enact this penalty.

Time-Outs

The following list of time-outs are available during game-play:

Player Time Out: Each player has one time-out per match. (In a tournament that involves rounds only, each player gets one time-out per round). This time-out can only be enacted between the time a goal is made until the time the ball is served and has a duration of about 2 minutes. This time-out must be verbally enacted by stating "Time Out" to a referee in a manner in which the referee can hear the request. If a player attempts to call a time-out, but they have already used it and no time-out exists, then no time-out will be acknowledged.

Official Time Out: This time-out can be enacted by the referees at their discretion and at any time during the game-play which stops as soon as the time-out is called. Game-play resumes with the defender ball 20 returning to the player who had clear possession at the time of the time-out. It should be appreciated that if this time-out is called during game-play, and no one player had clear possession of the defender ball 20, the game resumes after a face-off. The duration of this time-out is as long as the referees deem necessary. Clear possession includes, but is not limited to, the defender ball 20 being located in a player's goal zone at the time the time-out is called. Additionally, at their discretion, the referees can award a point to a player if the Official Time Out was called directly before a point scoring.

Emergency Time Out: An Emergency Time Out is put into effect when there is an injury in the sport court 100, a malfunction in the sport court 100, or broken equipment. This time-out is up to the discretion of the referees. Game-play stops as soon as the time-out is called and play resumes with the defender ball 20 returning to the person who had clear possession. As with the Official Time Out, if this time-out is called during game-play, and no one player had clear possession of the defender ball 20, the game resumes after a face-off. The duration of this time-out is as long as the referees deem necessary. Clear possession includes, but is not limited to, the defender ball 20 being in that person's goal zone. The referees can award a point to a player if the Emergency Time Out was called directly before a point scoring and is up to the discretion of the referees.

It should be appreciated that after any time-out is called, the referees have the final say on resuming the game. In the case of a Player Time Out, that player signifies his/her intention to the referees for a time-in. A time-in is when the game-play is started after an emergency time-out or an official time-out is called with a player having possession of the ball. The referees then can start the game by verbally announcing a time-in. The referees must let the players know when they have 30 seconds remaining and 5 seconds remaining until the time-in. At the end of the two minutes, the referees must initiate the game with a verbal "Time In." "Time Outs" and "Time Ins" must be verbally enacted by the players and referees alike. Moreover, for an In-Game time-in, the defender ball 20 does not have to start on the ground, as it would with a serve and as soon as the game has been started by a time-in, the 6 second Delay of Game Penalty countdown begins. Also, a player has the option to "decline" a penalty that was enacted on the opposing player. This must be verbally announced after a goal is scored and/or before the next serve is initiated. If a penalty is declined, that penalty and its effects are not enacted. Play resumes to where it would have been. The penalties that can be declined are the Encroachment and Illegal Kick Penalties.

Challenge

It should be appreciated that players may have the option to "challenge" a ruling of the referees. This challenge must be made verbally in a manner sufficient enough for the referees to hear and must be made after game-play had stopped, but before the next serve is made. Upon receiving a challenge, the referees must then call an Official Time Out to discuss the ruling/play. A challenge is decided by a majority vote of the referees. If a majority of referees vote to overturn a ruling/play, then the ruling/play can be overturned. However, if there is a no majority vote (such as a tie), then the ruling in the court stands. If not enough referees saw the play to come to a proper consensus, then the ruling in the court must be upheld. In order for a challenged play to be overturned, a minimum of two referee votes must be counted.

If a player challenges a ruling/play and the ruling/play in the court is upheld, the challenging player loses their time-out. If that player's time-out has already been used, then they lose 1 point. If the ruling is overturned, there is no penalty. Moreover, if a ruling/play is challenged, then the referees must discuss and vote whether or not to keep the ruling/play on the court or overturn it. If the ruling/play is overturned, then the player who would have had the defender ball 20 (or who had it) at the time the penalty was called, gets to serve. If it is unclear who has the right to the defender ball 20, then a face-off resumes play. It should be appreciated that once a flag has been thrown (indicating a penalty), then the remaining referees must not throw additional flags if they can help it. This is to limit the knowledge (in regards to whether that person should challenge the ruling/play) the player will get by seeing how the other referees determined the play. Furthermore, a player can call a "False Ruling" (between the time game-play stops and the next serve) against a referee if they think the referee is calling the game, helping a player, hurting a player, or making any unfair calls. If a player calls a False Ruling, the remaining referees must discuss and take a vote as to whether the False Ruling should be upheld. If the referee in question is charged with a False Ruling, the ruling/play is overturned (if there was a ruling/play in question) and the referee in question may be removed from the game immediately. The referees and/or Defender Board is then responsible for further action.

It should be appreciated that the "Defender Board" refers to a board of people that oversee Defender sport games and tournaments. This "Defender Board" may be established to discuss new rules, host tournaments, and oversee procedures in the sport game and may act as a commission.

If for any reason, a player feels like the result of a tournament did not come out fairly, that player has the option to protest the tournament. (That player must have played in a tournament to be able to do so). This being the case, the Defender Board must discuss the happenings of the tournament and the grievances put forth by the protester. The head of the Defender Board has a vote that counts as 1½ when a vote is needed. If a tournament has been ruled to be unfair, and the Defender Board votes in favor of the protester, then the tournament (in whole or in part) will take place where the protested acts took place (this can include any part of the tournament). Play would continue from just before the protested act had occurred. Statistics and standing would be redone from where the new game starts.

Referee Guidelines

It should be appreciated that if at any time a penalty, action, loophole, distraction, unspecified rule, or overlooked discrepancy arises, the referees will discuss and vote upon a ruling. That ruling is then honored. (It is up to the discretion of the referees to decide on how to start the game once something has been worked out). In tournament play there should be a minimum of two referees. In a Tournament, a "Head Referee" must be appointed and the Head Referee's vote will count as 1½ when a referee's vote is needed. If at any time a referee's input is needed or asked for, yet that referee did not see enough of the play in question, they are not obligated to yield input. In this case, they would simply not have a vote. During a tournament, all referees should carry two yellow flags, and one red flag on their person. The Head Referee should carry one black flag in addition to two yellow flags and one red flag. A flag must be thrown at the time the referee witnesses the penalty and should be thrown in the direction of where the penalty occurs. This indicates that a penalty has occurred. A whistle should also be blown at the time the referee witnesses the penalty. This whistle will indicate game-play to be stopped. It should be appreciated that game-play is officially ended at the time the penalty occurred, not when the whistle was blown or the flag was thrown. A whistle should be blown and accompanied by a flag toss with the exception of declinable penalties (i.e. Encroachment and Illegal Kick Penalties). In that case, the declinable penalty is indicated after the game-play ends.

It should also be appreciated that a 'warning' can be given to a player if they have come close to violating the Unsportsmanlike Conduct penalty. However, no warnings may be issued for the other penalties. Furthermore, during a game or tournament, two (more or less) areas may be designated for the referees to make calls. A referee can be placed in the goal or at any location around the court as long as that referee has the viewpoint to make accurate calls. Additionally, referee zones can be designated behind the goals on both sides of the court (This area is located typically four feet back from the back of a goal).

In accordance with the present invention, a referee handbook may be provided and may be used to complement the rules. This referee handbook may include the following information:

Penalties/Consequences

Yellow Flag Penalties

Encroachment Penalty: Loss of Point/Face Off
False Serve Penalty: Loss of Serve
False Start Penalty: Opponent's Serve
Out-of-Bounds Block Penalty: Opponent's Point
Illegal Kick Penalty: Opponent's Serve
Delay of Game: Opponent's Serve
Release of Goal Rod: Opponent's Serve
Illegal Ball Hold: Opponent's Serve Red Flag Penalties Illegal Contact: Loss of Point/Opponent's Serve
Unsportsmanlike Conduct: Loss of Point/Opponent's Serve Black Flag Penalty Ejection: Disqualification/Removal From Game Calling:

In order for referees to make calls of any kind, two referees should be in each Referee Zone. There can be referees outside the Referee Zones that make calls, but both Referee Zones should be occupied. If these areas are occupied, any penalty calls can be made, if appropriate. In addition, no Game-play should be allowed without the referees in their respective zones.

When a penalty (or a situation resulting from a penalty) occurs that ends Game-play, a whistle should accompany the penalty flag. This whistle would indicate the end of Game-play. In other circumstances where penalties occur, penalty flags alone do not end Game-play.

When a penalty occurs in the court, penalty flags should be thrown in the direction of where the penalty occurred.

Time Outs:

When a Time Out is needed in the court for any reason, or if a player legally can be granted a Time Out when asking for it, the referees should signal the Time Out with a whistle. It is suggested that this whistle be no shorter that 2 seconds in length. After the Time Out is granted, a referee should verbally acknowledge the type of Time Out that was called.

If at any time a player calls a Time Out, but does not have one, or calls for a Time Out during Game-play, a referee should not acknowledge the request. This is done so that the player isn't unfairly informed they don't have a Time Out or cannot call a time out at that time. It is the player's responsibility to keep track of this information. This way, by failing to remember, the player runs the risk of getting a Delay of Game Penalty.

Challenges:

When a player is granted a Challenge, all the referees present for the play should discuss and vote on a ruling. The referees should remove themselves from the court and enter into an area of privacy where they can discuss the play in question. The Head Referee, whether they had a vote in the discussion or not, should be the referee that announces the determination to the players.

Penalties:

Yellow Flag Penalties

Encroachment Penalty: Loss of Point/Face Off

This penalty is typically one of the most occurring penalties in the game. Referees are encouraged to keep a keen eye for Encroachment Penalties.

To further explain the definition of this penalty, the lines in the court should be looked at. When a particular line is in question, that line and the vertical plane above that line cannot be crossed. If the plane of the line is broken, and anything is touched on the other side, it is an Encroachment Penalty. To expand further, the line can be crossed, but it becomes a penalty only when something on the other side is contacted, including the ball.

What to watch for: (1) When players are close to their opponent's line during game play and turn quickly to return to their goal. Oftentimes players to not realize where they plant their feet when they turn around. (2) When players swing or reach for the ball that is in or near the opponent's goal zone. Oftentimes they reach for the ball as a reaction, and make contact with the ball, opponent, or goal zone, not realizing their actions.

False Serve Penalty: Loss of Serve

This penalty is another penalty that occurs often.

What to watch for: (1) In most cases, this penalty occurs when the ball or the player is outside the server's goal zone. Most often, the ball is rolling toward the center of the court. (2) When the ball is bouncing too high when served. For reference, this is defined as when a referee deems the ball to be bouncing over four inches in height when served.

False Start Penalty: Opponent's Serve

This is another common penalty. For referees, it is a straight forward penalty to look for.

What to watch for: (1) When a player does not have contact with their Goal Line when the Face-Off Whistle sounds.

Out-of-Bounds Block Penalty: Opponent's Point

This penalty is rare.

What to watch for: (1) When a player quickly attempts to serve the ball after he has been scored upon and still has a foot on the outside of the court.

Illegal Kick Penalty: Opponent's Serve

This penalty can be complicated at times. A referee should know what to look for.

What to look for: (1) Nothing in particular, just when players wrongfully kick the ball when it does not have proper forward movement toward their goal. (2) Remember, 'shuffling' the ball around and small kicks are permitted, as long as they do not lead to points. This 'shuffling' and 'small kicks' must be deemed as such by the referees. Shuffling the ball around and small kicks can be classified as any maneuver by the feet that are done with no intention to score. With the only intention being to simply maneuver the ball around (most plausibly moving it away from the reach of the opponent). If any of these 'small kicks' or 'shuffles of the ball' lead directly to a point (as in the last contact the kicker had with the ball was the kick that scored), it is considered an Illegal Kick Penalty.

Delay of Game: Opponent's Serve

Delay of Game is another penalty that is seen quite often.

What to look for: (1) Nothing in particular. (2) It is suggested that referees begin a countdown when a player places the ball in their goal zone after a point has been scored on them, or when the ball enters a player's goal zone during game play. (3) It is also suggested, due to the impracticality of devices such as stopwatches, that referees say "one thousand" (in their head) after every second in the countdown. The countdown from 6 should be done to imitate the length of seconds.

Release of Goal Rod: Opponent's Serve

Another rare penalty which can become complicated. It is obvious when a player losses control of their goal rod, but how or why it happened is the key.

What to look for: (1) When a goal rod is released by a player during game-play that endangers the opposing player. As a reference, this can be considered when the goal rod enters the other person's goal zone in a fast-moving fashion. (2) It is not a penalty if the player released the goal rod because of contact with the opponent or faulty equipment. (3) It is also not a penalty if the goal rod was released in defense of that player's goal. For example, if a player throws their goal rod at a ball that is rolling into their goal in an attempt to stop it because they were too far away to defend their goal in any other way. (4) It is suggested that referee discretion is used to work through each situation.

Illegal Hold: Opponent's Serve

This penalty does not occur often, but referees must be aware of the exact actions that cause this penalty.

What to look for: (1) When a player simple picks up the ball. (2) When a player holds the ball, any part of the opponent, including their goal rod, for longer than it would take to drop it. In all hold cases, the actual 'hold' can be determined by a count of two seconds. The second counting for this penalty should be done in the same way the Delay of Game count is done.

Red Flag Penalties

These penalties can happen at any time, not just during the game.

Illegal Contact: Loss of Point/Opponent's Serve

When a player unnecessarily makes rough contact with the opponent. In this case 'unnecessarily' is the key word. This is suggested that Illegal Contact be considered any contact (beyond light pushing), that does not directly help the other person reach the ball. It is also suggested that referee's discretion be used.

Unsportsmanlike Conduct: Loss of Point/Opponent's Serve

This penalty can be called for a variety of actions, many which cannot be specified or identified here.

When a player is disrespectful to Defender the Sport in any way. It is suggested that referee discretion be used in this case at all times.

Black Flag Penalty

Ejection: Disqualification/Removal from Game

An act that is beyond any red-flag penalty. This can be considered any 'red flag penalty act' that would not be properly punished by a red flag penalty. Use referee discretion.

If a player receives a third Red Flag Penalty in one round, a red flag should be thrown into the court along with the black flag to signal the Ejection Penalty.

It is suggested that a Head Ref, before making an Ejection call, calls an Official Time out to discuss the call with the other referees.

Referee discretion is the most important aspect of this penalty. Usually a referee will know when to enact an Ejection, but only the Head Referee should make the call.

Goal Rod Sets:

It should be appreciated that at least ½ of any goal rod 10 should be covered with padding. It is the padded side that should be used to strike the defender ball 20. A Goal Rod Set (one goal rod 10 per player) should be specified for each tournament. The goal rods 10 may include one padded portion or multiple padded portions.

At least half of the Goal Rod 10 must be covered in padding. However it is contemplated that players only use their body, a half rod or a mallet rod (See FIG. 5). It should be appreciated that if the players use half rods (or mallet rods), then each player may use two half rods (or mallet rods) as long as the players use the same type of rod. With mallet rods, at least ¾ of the Goal Rod in this set must be covered in padding, including the end. This set has the same weight as a typical 1 Goal Rod Set goal rod, with the extra weight from its shortened length residing in the padded end of the mallet rod.

The following are some examples of scenarios that may occur and are explained in relation to penalties and challenges:

Scenario 1—Encroachment Penalty

In this scenario, at least two situations may occur. One situation may involve player A placing the defender ball 20 in their goal zone after being scored upon and serves the defender ball 20 (attempts to score on the opponent). While player A is serving the defender ball 20, player B, in an attempt to block, steps over the centerline 122 and onto player A's side of the sport court 100. An Encroachment Penalty results because a player should be behind the centerline 122 when their opponent is serving. The resulting action would be that player B losses one point (unless player A declines) and game-play would continue after a face-off (i.e. an event in which the players can release contact with their Goal Line after the Face-Off Whistle sound).

Another situation may involve that during game-play, player A and player B hit the defender ball 20 back and forth until the defender ball 20 rolls into player A's goal zone. As this happens, player B reaches in and hits the ball 20 into player A's goal. Because player B touched something within player A's goal zone, in this case the ball 20, an Encroachment Penalty results. In this case (unless player A declines), the point would not score, player B would lose a point, and game-play would resume with a face-off.

Scenario 2—False Serve Penalty

In this scenario, at least two situations may occur. One situation may involve player A attempting a serve. As player A swings to strike the ball 20, he barely grazes the ball 20, sending the ball 20 slowly rolling out of his goal zone and into the neutral zone. Out of reaction, player A reaches out and attempts to hit the ball 20 again and successfully hits the ball 20. The moment the ball 20 crosses the centerline 122 after being hit in the neutral zone, a false serve penalty would result. This is because in order for a serve to count (be valid), the ball 20 should be hit from the server's goal zone and then cross the centerline 122. The hit that directly causes the ball 20 to cross the centerline 122 is the hit that is in question. Player B would get the serve as a result.

Another situation may involve when player A is scored upon. If player A grabs the ball 20 from the goal, tosses the ball 20 into the air and then serves the ball 20 into player B's goal, this would result in a False Serve Penalty because the ball 20 was not on the court base 102 for the serve. In this case, the goal would not count and player B would get the serve.

Scenario 3—Out of Bounds Penalty

In this scenario, player A serves the ball 20 across the sport court 100. As the ball 20 travels across the sport court 100, the ball 20 hits player B knocking him off balance and sending him backward into his goal (outside the sport court 100). Player A then hits the rebounding ball 20 back towards player B's goal, where player B blocks the ball 20 and then jumps back into his goal zone. The act of blocking the ball 20 would result in an Out of Bounds Penalty because a player should not touch the ball 20 while any part of their body is outside the sport court 100.

Scenario 4—Challenge

In this scenario, both player A and player B await the five second countdown for a face-off. Each player has their foot on the goal line as the five seconds pass and the face-off whistle sounds. As the players go for the ball 20, a penalty whistle sounds indicating a False Start Penalty on player A. Player A does not believe that she left the goal line early and thus does not believe that call is valid. Player A challenges the call by verbally indicating this to the referees. The referees then discuss and vote on a ruling. If it is determined that player A did leave early (i.e. did not have her foot on the goal line as the whistle sounded), then the penalty stands. Player B would then get to serve. And because a challenge was used, if player A had a time-out, then it would be taken away, if not, player A would lose a point. On the other hand, if it is determined that player A did not leave the goal line early (i.e. she did have her foot on the goal line as the whistle sounded), then the play (face-off) would be done over and the call on the sport court 100 would be overturned.

It should be appreciated that if the players choose to use goal rods 10 (as opposed to using only their appendages (hands and/or feet), that they may hit the defender ball 20 with the goals rods 10 and their hands and/or feet. Additionally, it should be appreciated that although the size of the defender ball 20 is preferably the size of a soccer or volley ball, the defender ball 20 may be any size suitable to the desired end purpose. For example, the defender ball 20 may be smaller or larger to increase or decrease the difficulty of the game.

While the invention has been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A plurality of articles for playing a sport game, the plurality of articles comprising:

a game ball;

a plurality of goal rods; and a sport court having a court top, a court base, two court sides and two court ends which define a game space, wherein, the court top includes open areas on each end of the court top, wherein the open areas are separated by a studded area, the court base is divided into four sections, wherein the four sections include goal zones separated by neutral zones, each of the two court sides include a lower flat portion and an upper studded portion having open areas between the studs, and each of the two court ends includes a goal opening.

2. The articles of claim 1, wherein the goal rod includes at least one handle portion and at least one padded portion, wherein the handle portion is about ½ inch thick and the padded portion is about 3 inches thick.

3. The articles of claim 2, wherein the handle portion of the goal rod includes a wrist strap and is wrapped in a gripping material.

4. The articles of claim 2, wherein the padded portion is constructed from a foam material.

5. The articles of claim 1, wherein the goal zones include a first goal zone located on a first end of the court base and a second goal zone located on a second end of the court base, The neutral zones include a first neutral zone located adjacent the first goal zone such that the first goal zone and first neutral zone are separated by a first goal zone line, and a second neutral zone located adjacent the second goal zone such that the second goal zone and second neutral zone are separated by a second goal zone line.

6. The articles of claim 5, where the two court ends include a first court end adjacent the first goal zone and having a first goal opening, and a second court end adjacent the second goal zone and having a second goal opening, wherein the first goal opening is separated from the first goal zone via a first goal line, and the second goal opening is separated from the second goal zone via a second goal line.

7. The articles of claim 1, wherein the game ball is constructed from a light plastic material.

8. The articles of claim 1, wherein the studded area and studded portion include a plurality of studs, wherein the plurality of studs are separated from each other by a predetermined distance.

9. A method of playing a game, wherein the game is played using a game ball, a plurality of goal rods and a sport court having a court top, a court base, two court sides and two court ends which define a game space, wherein, the court top includes open areas on each end of the court top, wherein the open areas are separated by a studded area, the court base is divided into four sections, wherein the four sections include goal zones separated by neutral zones, each of the two court sides include a lower flat portion and an upper studded portion with an open area between the studs, and each of the two court ends includes a goal opening and wherein the game is played by a first and second player in the game space of the sport court wherein each of the first and second player have a goal rod, the method comprising the steps of:

locating the first and second player and a game ball inside of the game space, such that the first player is on a first end of the game space and the second player is on a second end of the game space;

beginning game play by causing the first player to hit the game ball inside of the game space with the intent of making the game ball enter the second players goal opening;

continuing the game play by causing the second player to hit the game ball to prevent the game ball from entering the second players goal opening with the intent of making the game ball enter the first players goal opening; and maintaining game play until at least one of the first player and the second player achieves a point by hitting the game ball into the other players goal opening.

10. The method of claim 1, further comprising having a plurality of referees observe the game play to identify whether a violation of a rule from a predetermined set of rules has occurred.

11. The method of claim 10, wherein if a rule has occurred then, identifying which player violated the rule, and implementing a penalty action against the player who violated the rule.

12. The method of claim 1, wherein locating includes locating the game ball in a center area of the game space.

13. The method of claim 1, wherein locating includes locating each of the first player and second player such that a hand or foot of the first player is in contact with a goal line located on the first end of the game space and a hand or foot of the second player is in contact with a goal line located on the second end of the game space.

14. The method of claim 1, wherein locating includes at least one of locating the first player inside of a goal zone located on the first end of the game space and locating the second player inside of a goal zone located on the second end of the game space.

15. The method of claim 1, wherein maintaining includes causing game play to continue until a predetermined number of goals have been scored and/or a predetermined number of games have been played.

16. The method of claim 1, wherein the goal rod used by the first player is the same type as the goal rod used by the second player.

17. The method of claim 1, wherein the first player and second player each have two goal rods, wherein the goal rods used by the first player are the same type of goal rods used by the second player.

18. A method of playing a game, wherein the game is played by a first and second player in a game space of a sport court having a court top having open areas, a court base, two court sides and two court ends, wherein the open areas are separated by a studded area, the court base is divided into four sections that include goal zones separated by neutral zones, wherein each of the two court sides include a lower flat portion and an upper studded portion having open areas between the studs, and wherein the game is played using game ball and a plurality of goal rods and wherein each of the two court ends includes a goal opening, the method comprising the steps of:

locating the first and second player and a game ball inside of the game space, such that the first player is on a first end of the game space and the second player is on a second end of the game space;

beginning game play by causing the first player to hit the game ball inside of the game space with the intent of making the game ball enter the second players goal opening;

continuing the game play by causing the second player to hit the game ball to prevent the game ball from entering the second players goal opening with the intent of making the game ball enter the first players goal opening; and maintaining game play until at least one of the first player and the second player achieves a point by hitting the game ball into the other players goal opening.

19. The method of claim 18, wherein locating includes locating the game ball in a center area of the game space.

20. The method of claim 18, wherein beginning includes causing the first player to hit the game ball using at least one of a goal rod, a hand or a foot of the first player.

* * * * *